US009342025B2

(12) United States Patent
Soda et al.

(10) Patent No.: US 9,342,025 B2
(45) Date of Patent: May 17, 2016

(54) CONVEYOR DEVICE AND IMAGE FORMING APPARATUS

(71) Applicant: KYOCERA Document Solutions Inc., Osaka (JP)

(72) Inventors: Tomohisa Soda, Osaka (JP); Kazuhisa Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/626,354

(22) Filed: Feb. 19, 2015

(65) Prior Publication Data

US 2015/0241833 A1 Aug. 27, 2015

(30) Foreign Application Priority Data

Feb. 27, 2014 (JP) ..... 2014-036854
Jan. 28, 2015 (JP) ..... 2015-014420

(51) Int. Cl.
*G03G 15/00* (2006.01)
*B65H 29/70* (2006.01)
*B65H 85/00* (2006.01)

(52) U.S. Cl.
CPC ..... *G03G 15/6576* (2013.01)

(58) Field of Classification Search
CPC ... G03G 29/70; G03G 15/00; G03G 15/6576; B65H 85/00; B65H 23/34; B41J 2/01; B41J 2/165
USPC ..... 399/401, 406
See application file for complete search history.

(56) References Cited

U.S. PATENT DOCUMENTS 5,905,934 A * 5/1999 Koshimizu ..... B41J 3/60 271/161
7,467,790 B2 * 12/2008 Westhoff ..... B65H 3/0615 271/3.14
7,506,948 B2 3/2009 Nonaka
7,653,340 B2 * 1/2010 Shida ..... B65H 29/70 399/406
2006/0038870 A1 2/2006 Nonaka
2007/0070171 A1 * 3/2007 Matsuno ..... G03G 15/6573 347/224
2007/0132174 A1 * 6/2007 Yamane ..... B41J 11/0005 271/188
2009/0297243 A1 * 12/2009 Matsuno ..... G03G 15/6576 399/405

(Continued)

FOREIGN PATENT DOCUMENTS

JP 03200663 A * 9/1991 ..... G03G 15/00
JP 07267454 A * 10/1995 ..... G03G 15/00
JP H07-291508 A 11/1995

(Continued)

*Primary Examiner* — Nguyen Ha
(74) *Attorney, Agent, or Firm* — Studebaker & Brackett PC

(57) ABSTRACT

A conveyor device is mounted on an image forming apparatus having an image forming section. The conveyor device has: a first conveyance path for conveying the sheet after an image is formed on a side of a sheet by the image forming section; a reverse conveyance path branched from the first conveyance path; a second conveyance path branched from the reverse conveyance path and for conveying the sheet back to the image forming section. The conveyor device includes a reversing section and a decurling section that are disposed on the reverse conveyance path. The reversing section reverses a conveyance direction of the sheet fed into the reverse conveyance path so as to feed the sheet into the second conveyance path. The decurling section applies decurling by urging the sheet in a direction of forming a convex curl with a side opposite to the image-formed side facing outward.

16 Claims, 7 Drawing Sheets

(56) References Cited

U.S. PATENT DOCUMENTS

2009/0304429 A1* 12/2009 Makinodan ..... G03G 15/235 399/406
2015/0003883 A1* 1/2015 Honda ..... G03G 15/6529 399/406

FOREIGN PATENT DOCUMENTS

JP 09062145 A * 3/1997 ..... G02G 21/00
JP 10077152 A * 3/1998 ..... B65H 29/70
JP 10139248 A * 5/1998 ..... G03G 15/00
JP H10-194547 A 7/1998
JP 11171387 A * 6/1999 ..... B65H 29/70
JP 2000-044100 A 2/2000
JP 2002-020015 A 1/2002
JP 2006-082546 A 3/2006
JP 2006232500 A * 9/2006 ..... B41J 2/01
JP 2009029554 A * 2/2009 ..... B65H 29/70
JP 2011031993 A * 2/2011 ..... B65H 29/70
JP 2012101878 A * 5/2012 ..... G03G 15/00
JP 2013159478 A * 8/2013 ..... B65H 29/70
JP 2013216468 A * 10/2013 ..... B65H 29/70

* cited by examiner

CONVEYOR DEVICE AND IMAGE FORMING APPARATUS

INCORPORATION BY REFERENCE

The present application claims priority under 35 U.S.C. §119 to Japanese Patent Applications No. 2014-036854, filed Feb. 27, 2014 and No. 2015-14420, filed Jan. 28, 2015. The contents of these applications are incorporated herein by reference in their entirety.

BACKGROUND

The present disclosure relates to conveyor devices and image forming apparatuses.

Typical image forming apparatuses are known to use water-based ink to form an image on paper (sheet). When an image is formed on a sheet of paper with water-based ink, the side of the sheet on which the image is formed expands. Thus, the sheet curls to form a convex curl with the image-formed side facing outward. For example, paper curl occurs when cellulose fibers, which are the main component of paper, are swelled with water-based ink.

Consequently, when an image forming apparatus forms an image on a sheet and conveys the sheet back to a position immediately under a recording head of the image forming apparatus, edges of the sheet are curled up toward the recording head. As a result, the sheet may contact with the recoding head. Contact between the recording head and a sheet may cause staining of the sheet. Contact between the recording head and a sheet may also cause paper jam in the image forming apparatus. One measure to prevent a sheet from contacting the recording head is to reverse the curl in the sheet in the opposite to suppress the edges from being curled up toward the recording head.

SUMMARY

According to a first aspect of the present disclosure, a conveyor device is for mounting on an image forming apparatus. The image forming apparatus includes an image forming section for forming an image on a sheet. The conveyor device has a first conveyance path, a reverse conveyance path, and a second conveyance path. The conveyor device includes a reversing section, and a decurling section. The first conveyance path is for conveying the sheet after an image is formed on a side of a sheet by the image forming section. The reverse conveyance path is branched from the first conveyance path. The second conveyance path is branched from the reverse conveyance path and for conveying the sheet back to the image forming section. The reversing section and the decurling section are disposed on the reverse conveyance path. The reversing section reverses a conveyance direction of the sheet that is fed into the reverse conveyance path so as to feed the sheet into the second conveyance path. The decurling section applies decurling by urging the sheet in a direction of forming a convex curl with a side opposite to the image-formed side facing outward.

According to a second aspect of the present disclosure, an image forming apparatus includes the conveyor device according to the first aspect of the present disclosure and the image forming section. The image forming section is configured to form an image on a sheet.

DETAILED DESCRIPTION

The following describes an embodiment of the present disclosure with reference to the accompanying drawings. Note that the same reference signs are used to denote the same or corresponding elements, and no overlapping explanation is repeated.

[Basic Principle]

Figure 1:
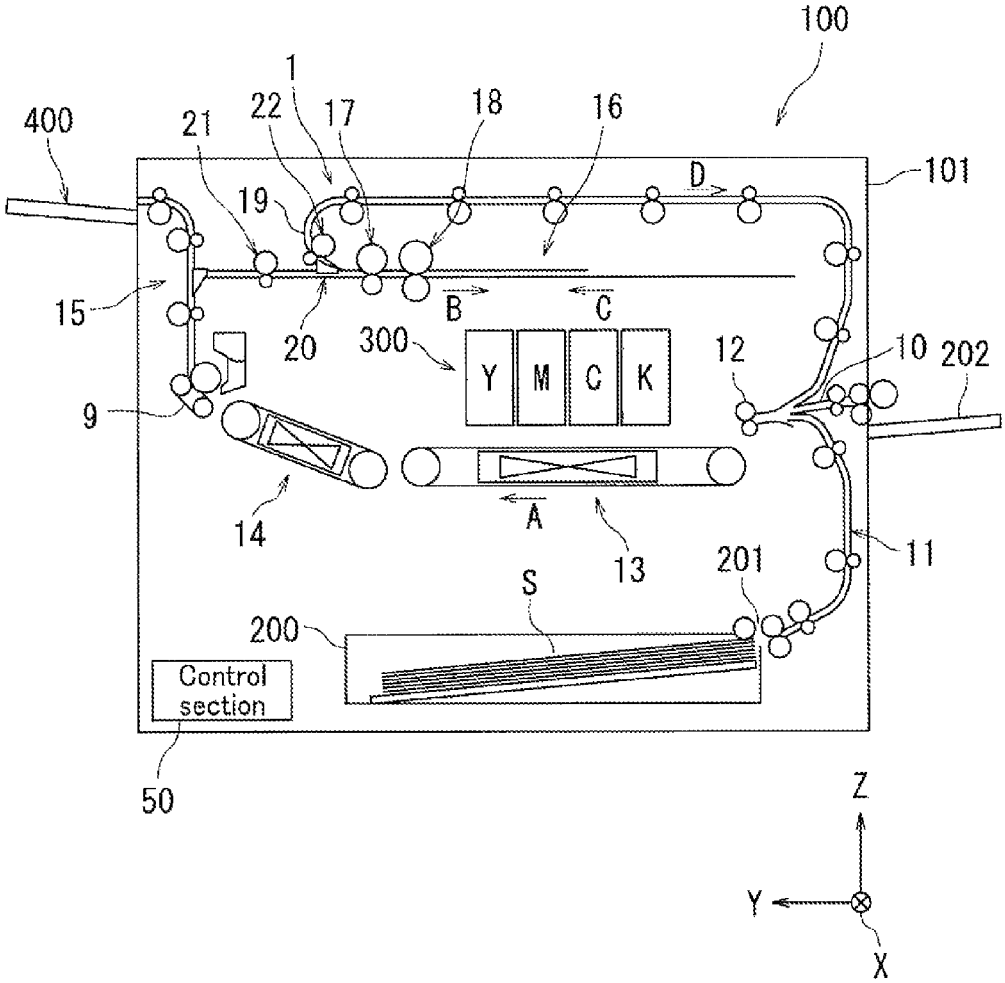
FIG. 1 shows a schematic configuration of an image forming apparatus having a conveyor device according to an embodiment of the present disclosure.

With reference to FIG. 1, the basic principle of a conveyor device 1 according to an embodiment of the present disclosure is explained. FIG. 1 shows a schematic configuration of an image forming apparatus 100 having the conveyor device 1. The conveyor device 1 is mounted on the image forming apparatus 100 having an image forming section 300 for forming an image on a sheet S. The conveyor device 1 has a first conveyance path 15, a reverse conveyance path 16, and a second conveyance path 19. The conveyor device 1 includes a reversing section 18 and a decurling section 17.

The first conveyance path 15 is used to convey a sheet S after an image is formed on a side of the sheet S by the image forming section 300. The reverse conveyance path 16 is branched from the first conveyance path 15. The second conveyance path 19 is branched from the reverse conveyance path 16 and used to convey the sheet S back to the image forming section 300. The reversing section 18 and the decurling section 17 are disposed on the reverse conveyance path 16. The reversing section 18 reverses the conveyance direction of the sheet S that is fed into the reverse conveyance path 16 so as to feed the sheet S into the second conveyance path 19. The decurling section 17 applies decurling to the sheet S by urging the sheet S in a direction of forming a convex curl with a side opposite to the image-formed side facing outward.

According to the present embodiment, the decurling section 17 is disposed on the reverse conveyance path 16 and applies decurling by urging the sheet S in a direction of forming a convex curl with the side opposite to the image-formed side facing outward. Thus, the sheet S is ensured not to have edges curling up toward the image forming section 300 when the sheet S is conveyed back to the image forming section 300. As a result, the edges of the sheet S are prevented from contacting the image forming section 300.

With reference to FIG. 1, the image forming apparatus 100 is explained. In the following explanation of the present embodiment, the two sides of a sheet S are referred to as a first printed side and a second printed side. The first printed side is one on which an image is formed in an initial printing process by the image forming section 300. The second printed side is the one that faces away from the first printed side and on which an image is formed in a subsequent printing process by the image forming section 300. In FIG. 1, the X axis is parallel to a direction perpendicular to a conveyance direction A in which a sheet S is conveyed during image formation by the image forming section 300. The Y axis is parallel to the conveyance direction A of the sheet S. The Z axis is perpendicular to a longitudinal direction of a first belt conveyor section 13. In the present embodiment, the Z axis extends in a vertical direction, and the X, Y, and Z axes intersect one another at a right angle.

As shown in FIG. 1, each of the conveyance directions A, B, C, and D is a direction in which a sheet S is conveyed. The conveyance direction A is parallel to and coincides with the positive Y-axis direction. The conveyance direction B is opposite to the positive Y-axis direction. The conveyance direction C is parallel to and coincides with the positive Y-axis direction. The conveyance direction D is opposite to the positive Y-axis direction.

The image forming apparatus 100 includes the conveyor device 1, a housing 101, a paper feed cassette 200, a paper feed section 201, a manual paper feed tray 202, the image forming section 300, and a sheet exit tray 400.

The conveyor device 1 includes a displacement sensor 9, a pair of registration rollers 12, the first belt conveyor section 13, a second belt conveyor section 14, a branch section 20, a first conveyance roller 21, and a second conveyance roller 22. The conveyor device 1 has a first sheet conveyance path 10 and a second sheet conveyance path 11.

The displacement sensor 9 is disposed between the second belt conveyor section 14 and the first conveyance path 15. The first sheet conveyance path 10 extends between the manual paper feed tray 202 and the first belt conveyor section 13. The second sheet conveyance path 11 extends along a side of the image forming section 300. The pair of registration rollers 12 is disposed near the common exit of the first sheet conveyance path 10 and the second sheet conveyance path 11.

The first belt conveyor section 13 is disposed to face the image forming section 300. The second belt conveyor section 14 extends between the first belt conveyor section 13 and the displacement sensor 9. The first conveyance path 15 extends between the displacement sensor 9 and the sheet exit tray 400. The reverse conveyance path 16 is branched from the first conveyance path 15. The decurling section 17 is disposed on the reverse conveyance path 16.

The reversing section 18 is disposed on the reverse conveyance path 16. The second conveyance path 19 branches from the reverse conveyance path 16. The branch section 20 is disposed upstream on the reverse conveyance path 16 from the decurling section 17 in the conveyance direction B of the sheet S. The branch section 20 is where the second conveyance path 19 is branched from the reverse conveyance path 16. The first conveyance roller 21 is disposed upstream on the reverse conveyance path 16 from the branch section 20 in the conveyance direction B of the sheet S. The second conveyance roller 22 is disposed near the entrance of the second conveyance path 19.

The displacement sensor 9 measures an amount of curl of the sheet S. A sheet S fed from the manual paper feed tray 202 is conveyed though the first sheet conveyance path 10 generally horizontally toward the left within the housing 101. A sheet S fed from the paper feed cassette 200 is conveyed through the second sheet conveyance path 11 vertically upward along the side surface of the housing 101. Note that pairs of conveyance rollers are disposed at appropriate locations on the first sheet conveyance path 10 and the second sheet conveyance path 11 for conveying the sheet S.

The pair of registration rollers 12 forward a sheet S toward the first belt conveyor section 13 in a timed relation with the ink ejection by the image forming section 300, while correcting skewing of the sheet S. The first belt conveyor section 13 conveys the sheet S having passed between the registration rollers 12. While the sheet S is conveyed by the first belt conveyor section 13, the image forming section 300 forms an image on a side of the sheet S. The second belt conveyor section 14 is used to convey the sheet S having the image formed thereon by image forming section 300. Ink ejected onto the surface of the sheet S dries while the sheet S is conveyed through the second belt conveyor section 14.

The sheet S fed into the second conveyance path 19 by the reversing section 18 is conveyed through the second conveyance path 19 to a position immediately under the image forming section 300. The conveyance path of the sheet S is branched at the branch section 20 into a path for feeding the sheet S conveyed from the first conveyance path 15 into the reverse conveyance path 16 and a path for feeding the sheet S conveyed from the reverse conveyance path 16 into the second conveyance path 19. The first conveyance roller 21 feeds the sheet S fed from the first conveyance path 15 into the reverse conveyance path 16. The second conveyance roller 22 feeds the sheet S conveyed from the reverse conveyance path to the image forming section 300.

The paper feed cassette 200 is disposed at a lower portion of the housing 101. The paper feed section 201 is disposed above one edge of the paper feed cassette 200. The manual paper feed tray 202 is externally disposed on the right surface of the housing 101.

The paper feed cassette 200 stores a plurality of sheets S in stack. The paper feed cassette 200 is detachably attached to the housing 101. The paper feed section 201 separates sheets S stacked in the paper feed cassette 200 one at a time and feeds the separated sheet S into the second sheet conveyance path 11. The manual paper feed tray 202 is used for placing sheets S thereon, examples of such sheets S include sheets of a size different from those stored in the paper feed cassette 200, thick paper, overhead projector (OHP) sheets, envelopes, postcards, and shipping labels. The sheets S placed on the manual paper feed tray 202 are separated one at a time and fed into the first sheet conveyance path 10 toward the pair of registration rollers 12.

The image forming section 300 is disposed above the first belt conveyor section 13. The sheet exit tray 400 is attached to the housing 101 so as to extend from an exit slot (not shown) provided in the housing 101 outwardly toward the left of the image forming apparatus 100. The image forming section 300 forms an image on a sheet S. A sheet S not conveyed to the reverse conveyance path 16 is discharged to the sheet exit tray 400.

The first belt conveyor section 13 conveys the sheet S in the conveyance direction A. The sheet S then enters the reverse conveyance path 16 in the conveyance direction B. The reversing section 18 feeds the sheet S from the reverse conveyance path 16 into the second conveyance path 19 in the conveyance direction C. The sheet S fed into the second conveyance path 19 by the reversing section 18 is conveyed through the second conveyance path 19 to reach a position immediately under the image forming section 300.

The conveyor device 1 further includes a control section 50. The control section 50 controls relevant rollers included in the conveyor device 1 based on one or more parameters. For example, the one or more parameters are at least one from among an amount of curl of the sheet S, the material of the sheet S, the size of the sheet S, the thickness of the sheet S, the temperature of the conveyor device 1, the humidity in the conveyor device 1, and the image density of the image formed on the sheet S. The parameters may be arranged in a table stored in the image forming apparatus 100 or stored in an external device connected to the image forming apparatus 100. The external device may be flash memory, such USB memory, or an external server.

Figure 2A:
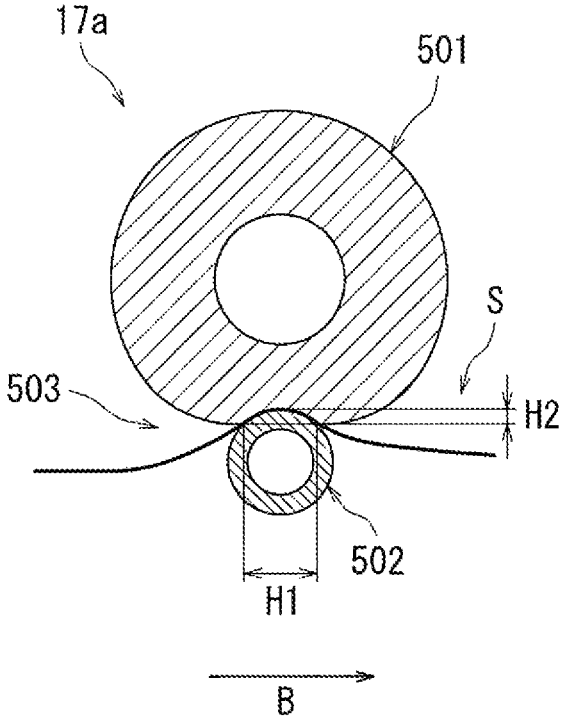
FIGS. 2A and 2B each show a decurling section included in the conveyor device according to the embodiment of the present disclosure.
Figure 2B:
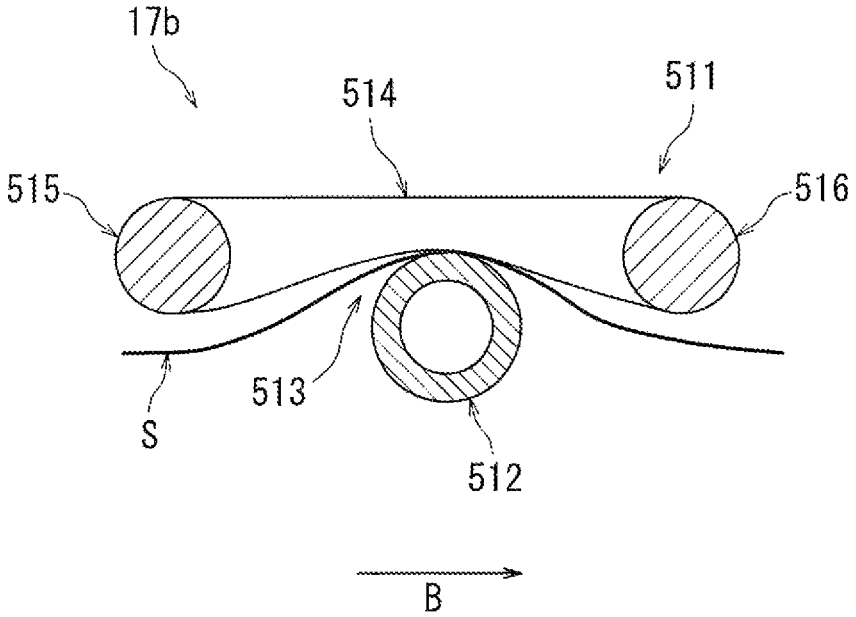

With reference to FIGS. 1, 2A, and 2B, the following explains the decurling section 17 in detail. FIG. 2A shows a decurling section 17*a*, which is one example of the decurling section 17 included in the conveyor device 1. FIG. 2B shows a decurling section 17*b*, which is an example of the decurling section 17 included in the conveyor device 1. When a sheet S conveyed to a position immediately under the image forming section 300 has an edge curled up toward the image forming section 300 (i.e., when the sheet S has a convex curl with the first printed side facing outward), the edge of the sheet S may contact the image forming section 300. To address the above, the decurling section 17 applies decurling by urging the sheet S in the direction of forming a convex curl with the second printed side facing outward. This can prevent the sheet S from contacting the image forming section 300 at the edges.

The decurling section 17 is disposed on the reverse conveyance path 16 at a position between the branch section 20 and the reversing section 18. Consequently, the sheet S passes thought the decurling section 17 twice: once when entering the reverse conveyance path 16 and once when exiting the reverse conveyance path 16. Naturally, the amount of decurling applied by the decurling section 17 is larger as compared to the case where the sheet S passes thought the decurling section 17 only once.

The decurling section 17 may be a structure that includes two rollers paired with each other, a structure that includes a belt and a roller that is paired with the belt, or a structure that includes two belts paired with each other, for example. With reference to FIG. 2A, the following explains the decurling section 17*a* including two rollers that are paired with each other. As shown in FIG. 2A, the decurling section 17*a* includes a soft roller 501, which is a rotary body made from a soft material, and a hard roller 502, which is a rotary body made form a hard material.

The soft roller 501 is disposed to face the second printed side of the sheet S being conveyed though the reverse conveyance path 16. The hard roller 502 is disposed to face the first printed side of the sheet S being conveyed though the reverse conveyance path 16.

The soft roller 501 is made from a soft material, such as formed sponge. The amount of decurling applied to the sheet S increases with an increase in the outer diameter of the soft roller 501. Yet, when the outer diameter of the soft roller 501 is too large, decurling may not be applied to the sheet S. Therefore, the outer diameter of soft roller 501 is preferably within a range of ϕ15 mm to ϕ40 mm. More preferably, the outer diameter of the soft roller 501 is within a range of ϕ20 mm to ϕ30 mm. The amount of decurling applied to the sheet S increases with a decrease in the hardness of the soft roller 501. Yet, there may be a case where decurling is not sufficiently applied when the soft roller 501 is of low hardness and the sheet S is stiff. In view of this, the Asker C hardness of the soft roller 501 is preferably within a range of 5° to 40°. More preferably, the Asker C hardness of the soft roller 501 is within a range of 15° to 25°.

The hard roller 502 is made from a hard material, such as metal. The amount of decurling applied to the sheet S increases with a decrease in the outer diameter of the hard roller 502. Therefore, the outer diameter of the hard roller 502 is preferably within a range of ϕ5 mm to ϕ30 mm. More preferably, the outer diameter of the hard roller 502 is within a range of ϕ6 mm to ϕ100 mm.

The hard roller 502 is in contact with the soft roller 501 under pressure. Therefore, a nip part 503 that is curved is formed between the hard roller 502 and the soft roller 501. The hard roller 502 is driven to rotate by a drive source (not shown) such as a stepping motor. The soft roller 501 rotates by following the rotation of the hard roller 502. The sheet S being conveyed passes through the nip part 503. More specifically, during the time sheet S passes through the nip part 503, the sheet S is sandwiched between the soft roller 501 and the hard roller 502. As a result, the sheet S undergoes plastic deformation, conforming to the shape of the nip part 503.

Now, a nip width H1 of the decurling section 17 is explained. The nip width H1 refers to the width with which the soft roller 501 and the hard roller 502 contact each other in the conveyance direction B of the sheet S. When the nip part 503 is seen in the direction of the Z axis, the nip width H1 may vary from time to time. The variations of the nip width H1 result from the flexure of the hard roller 502 and/or the tolerance on the outer diameter of the hard roller 502. Preferably, the nip width H1 on average is 2.5 mm or more. More preferably, the nip width H1 on average is 5 mm or more.

With reference to FIG. 2B, the following explains the decurling section 17*b* including a roller and a belt that is paired with the roller. As shown in FIG. 2B, the decurling section 17*b* is a structure that includes a belt section 511 and a hard roller 512, which is a rotary body made from a hard material. The belt section 511 includes an endless belt 514, a drive roller 515, and a driven roller 516.

The belt section 511 is disposed to face the second printed side of the sheet S being conveyed in the reverse conveyance path 16. The hard roller 512 is disposed to face the first printed side of the sheet S being conveyed in the reverse conveyance path 16. The endless belt 514 is tautly wound around the drive roller 515 and the driven roller 516.

The endless belt 514 is an elastic body. The drive roller 515 is driven to rotate by a drive source (not shown), supplying a drive force to run the endless belt 514. The driven roller 516 is rotatably disposed and rotates by following the endless belt 514 that is driven by the drive roller 515.

The hard roller 512 is in contact with the endless belt 514 under pressure so that a nip part 513 that is curved is formed between the hard roller 512 and the endless belt 514. The sheet S being conveyed passes through the nip part 513. More specifically, during the time sheet S passes through the nip part 513, the sheet S is sandwiched between the endless belt 514 and the hard roller 512. As a result, the sheet S undergoes plastic deformation conforming to the shape of the nip part 513.

With reference to FIG. 2A, the following explains an amount of decurling applied to the sheet S, by way of an example directed to the decurling section 17*a*. The control section 50 controls the decurling section 17*a* according to one or more parameters so as to adjust the amount of decurling applied to the sheet S. More specifically, the control section 50 adjusts the roller-separation distance of the decurling section 17*a* to adjust the amount of decurling applied to the sheet S. The roller-separation distance refers to the distance between the axial center of the soft roller 501 and the axial center of the hard roller 502. The roller-separation distance of the decurling section 17*a* determines the nip width H1 of the decurling section 17*a* as well as an engaging depth H2 of the decurling section 17*a*. The engaging depth H2 refers to the depth of a portion of the hard roller 502 pressed into the soft roller 501 in a direction perpendicular to the conveyance direction B of the sheet S when the hard roller 502 is pressed against the soft roller 501.

The amount of decurling applied to the sheet S is determined according to the one or more parameters. For example, a sheet S may be an envelope and thus thicker than plain paper, and such a sheet S is more readily affected by decurling. Therefore, for a sheet S that is thicker than plain paper, the roller-separation distance between the soft roller 501 and the hard roller 502 is widen as compared with the roller-separation distance set for decurling of plain paper. This can reduce the amount of decurling applied to the sheet S.

Figure 3A:
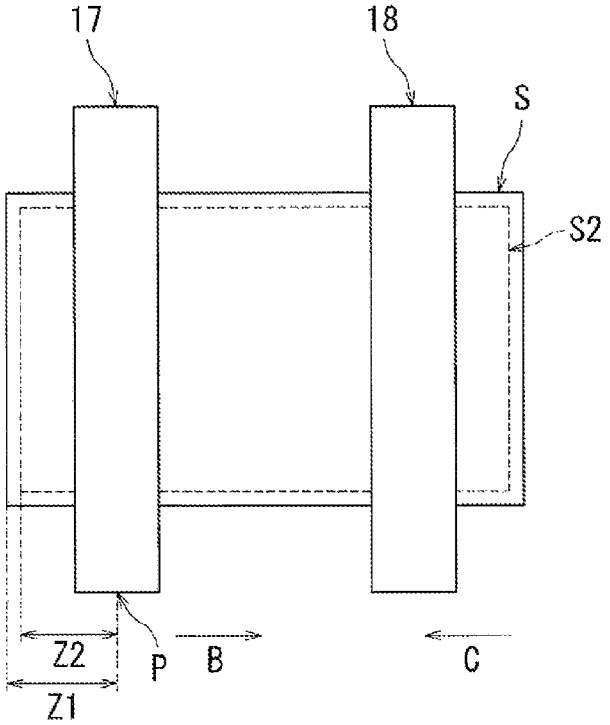
FIGS. 3A and 3B each show a stop position at which a sheet is stopped in a reverse conveyance path of the conveyor device according to the embodiment of the present disclosure.
Figure 3B:
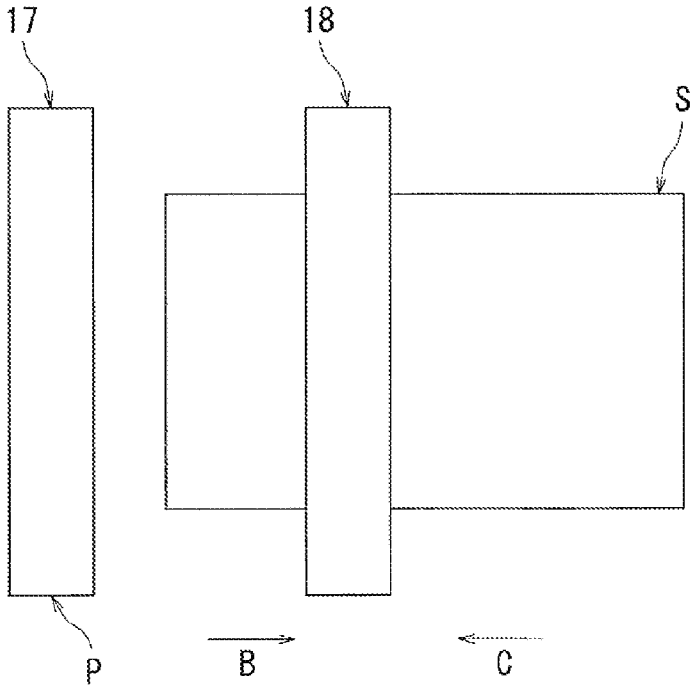

With reference to FIGS. 1 to 3B, the following explains the stop position of the sheet S on the reverse conveyance path 16. FIGS. 3A and 3B each show a stop position of the sheet S on the reverse conveyance path 16. A printable region S2 of the sheet S is enclosed by a broken line. The printable region S2 of a sheet S is a maximum region available for printing by the image forming section 300. Note that the broken line in FIG. 3A indicating the printable region S2 is used for the convenience sake. In practice, no such a line exists. The center of the decurling section 17 in the conveyance direction B is designated as a reference P. On condition that the trailing edge of the sheet S is located upstream from the reference P in the conveyance direction B, Z1 denotes the distance from the reference P to the trailing edge of the sheet S, and Z2 denotes the distance from the reference P to the trailing edge of the printable region S2. The control section 50 controls the reversing section 18 based on the one or more parameters. Through the control of the reversing section 18, the control section 50 adjusts the position at which the sheet S is stopped in the reverse conveyance path 16.

As shown in FIG. 3A, the control section 50 controls the reversing section 18 according to the one or more parameters so as to cause the sheet S to be stopped at a position where the sheet S contacts the decurling section 17. For example, the control section 50 may employ a jam detection sensor (not shown) to adjust the stop position of the sheet S. The jam detection sensor is disposed on the reverse conveyance path 16. The jam detection sensor detects jamming of the sheet S in the image forming apparatus 100. The control section 50 suspends the conveyance of the sheet S by stopping a motor (not shown) of the reversing section 18 upon expiry of a predetermined time period starting when the jam detection sensor detects the leading edge of the sheet S. This time period is determined according to the one or more parameters.

The control section 50 controls the reversing section 18 based on the one or more parameters so as to cause the sheet S to be stopped at a position where the sheet S contacts the decurling section 17. The decurling section 17 applies decurling to the sheet S by sandwiching the sheet S. Upon expiry of a predetermined time period starting when the decurling section 17 sandwiches the sheet S, the control section 50 drives the motor of the reversing section 18. The reversing section 18 reverses the conveyance direction of the sheet S from the conveyance direction B to the conveyance direction C so as to convey the sheet S toward the second conveyance path 19. The decurling section 17 applies decurling to the leading edge of the sheet S entering the second conveyance path 19. Therefore, the sheet S conveyed back to a position immediately under the image forming section 300 is ensured not to be curled up toward the image forming section 300 at the edges. As a result, the sheet S is prevented from contacting the image forming section 300 at the edges.

The following explains a suitable position in the reverse conveyance path 16 for temporarily stopping the sheet S. When the sheet S enters the reverse conveyance path 16, it is preferable to temporarily stop the sheet S at a position where the length Z1 of the sheet S is within a range of 0 mm and 20 mm. More preferably, the sheet S is temporarily stopped at a position where the length Z2, which is the distance from the trailing edge of the printable region S2 of the sheet S, is within a range of 0 mm and 5 mm. The printable region S2 of a sheet S differs depending on an image forming apparatus mounting the conveyor device 1.

Note that with the setting to increase the image density of an image formed on the sheet S, the image forming section 300 ejects a larger amount of ink onto the sheet S. Naturally, the side of the sheet S on which an image is formed expands to a greater extent when the density of the image formed is higher than when it is lower. That is, the amount of curl of the sheet S increases with an increase in the density of an image formed on the sheet S. In view of the above, a sheet S is expected to curl such that the curvature of the curl is locally greater at a portion with a higher image density than at a portion with a lower image density. Therefore, the control section 50 may use the density of the image formed on the sheet S as a parameter to determine the stop position of the sheet S on the reverse conveyance path 16.

For example, when an image formed on a sheet S includes a portion with a high coverage rate at a position corresponding to the length Z1 of 10 cm, the sheet S is expected to curl such that the curvature of the curl is locally greater at the portion corresponding to the length Z1 of 10 cm. Therefore, the control section 50 suspends the conveyance of the sheet S such that the decurling section 17 sandwiches the sheet S at the portion corresponding to the length Z1 of 10 cm. As a result, decurling is applied to the sheet S at a higher curvature portion of the sheet S, by urging the sheet S in a direction of forming a convex curl with the second printed side facing outward. The decurling applied in this manner can prevent the sheet S from contacting the image forming section 300 at the edges when the sheet S is conveyed back to a position immediately under the image forming section 300.

As described above, the control section 50 holds the sheet S in standby with the sheet S partially sandwiched by the decurling section 17. The conveyor device 1 includes components for conveying the sheet S having been subjected to the decurling. That is, curl of the sheet S is corrected to the maxim possible extent such that the sheet S can be smoothly delivered to a position immediately under the image forming section 300. As a result, the sheet S is prevented from contacting the image forming section 300 at the edges.

When the sheet S is stopped in the state being sandwiched by the decurling section 17, the sheet S is locally subjected to intensive decurling. In such a case, when the decurling section 17 applies excessive decurling to the sheet S, the curl of the sheet S is awkwardly corrected. In addition, when the amount of curl of the sheet S caused by ink ejection is small, decurling of the sheet S may also result in awkwardly corrected curl. In view of the above, the control section 50 may temporarily stop the sheet S in the reverse conveyance path 16 at a position where the sheet S is clear of the decurling section 17 as shown in FIG. 3B. This prevents awkward decurling of the sheet S by the decurling section 17.

With reference to FIGS. 4A-5B, the following explains the displacement sensor 9. The conveyor device 1 is additionally provided with the displacement sensor 9 that detects the amount of curl of the sheet S. The displacement sensor 9 may be a distance sensor 9*a* or a pressure sensor 9*b*, for example.

Figure 4A:
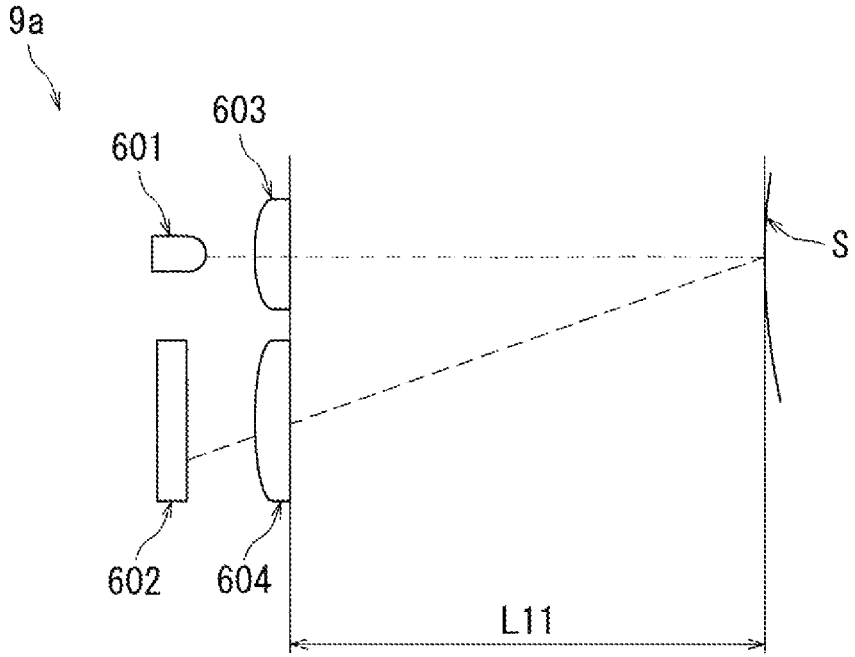
FIGS. 4A and 4B show a distance sensor that is an example of a displacement sensor included in the conveyor device according to the embodiment of the present disclosure.
Figure 4B:
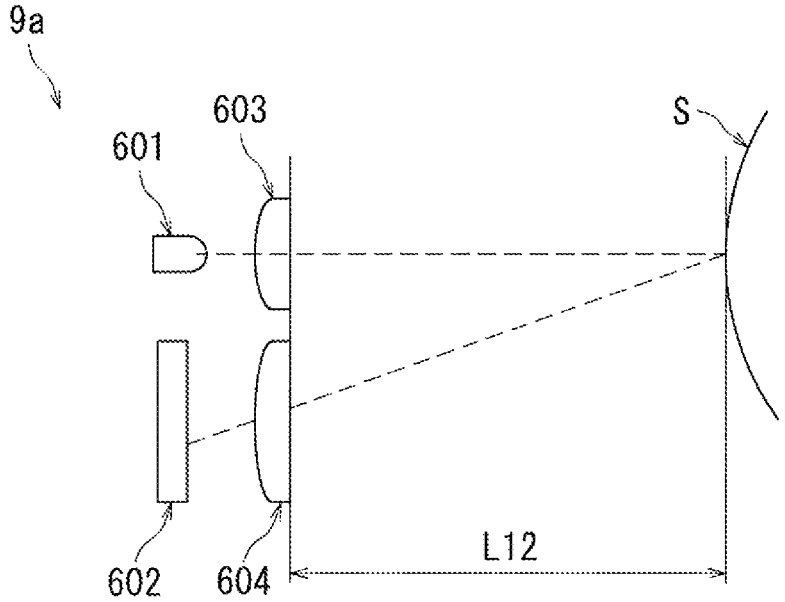

With reference to FIGS. 4A and 4B, the following explains the distance sensor 9*a* as an example of the displacement sensor 9. FIGS. 4A and 4B show the distance sensor 9*a*. The distance sensor 9*a* includes a light-emitting element 601, a position sensitive detector (PSD) 602, a projecting lens 603, and a receiving lens 604. The light emitting element 601 may be an LED, for example.

Light emitted by the light emitting element 601 passes through the projecting lens 603 and is reflected by a sheet S. The light reflected from the sheet S passes through the receiving lens 604 to enter the position sensitive detector 602. The position sensitive detector 602 detects the incident position of the light. The incident position of the light on the position sensitive detector 602 varies proportionally to the distance from the distance sensor 9*a* to the sheet S. Based on the incident position of the light on the position sensitive detector 602, the distance sensor 9*a* supplies to the control section 50 a detection signal indicating the distance from the distance sensor 9*a* to the sheet S. The detection signal therefore indicates the amount of curl of the sheet S as explained below.

As shown in FIGS. 4A and 4B, when the amount of curl of the sheet S is smaller, the distance between the sheet S and the distance sensor 9*a* denoted by L11 is longer. When the amount of curl of the sheet S is larger, the distance between the sheet S and the distance sensor 9*a* denoted by L12 is shorter (L11>L12). Consequently, with a detection signal indicating the distance between the sheet S and the distance sensor 9*a* supplied from the distance sensor 9*a*, the control section 50 can detect the amount of curl of the sheet S.

Figure 5A:
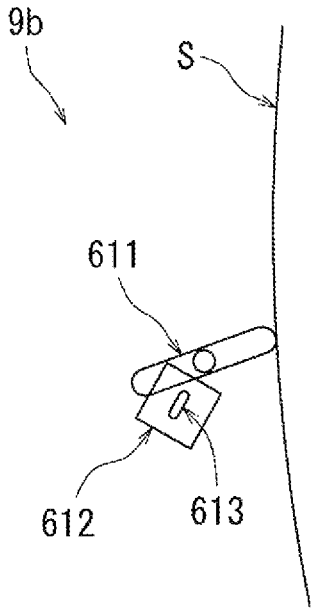
FIGS. 5A and 5B show a pressure sensor that is an example of the displacement sensor included in the conveyor device according to the embodiment of the present disclosure.
Figure 5B:
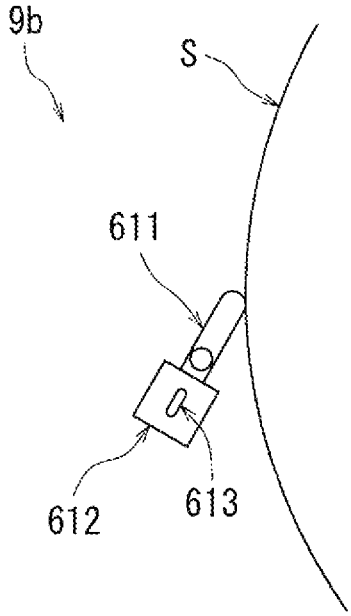

With reference to FIGS. 5A and 5B, the following explains the pressure sensor 9*b* as an example of the displacement sensor 9. FIGS. 5A and 5B show the pressure sensor 9*b*. The pressure sensor 9*b* includes a flag 611 and an actuator 612. The flag 611 is tilted by a sheet S upon contact with the sheet S. The amount of tilting of the flag 611 increases with an increase in the amount of curl of the sheet S. The actuator 612 detects the amount of tilting of the flag 611 and determines whether or not the flag 611 is tilted beyond a flag detection position 613. The pressure sensor 9*b* supplies a detection signal indicating the determination result of the actuator 612 to the control section 50.

As shown in FIG. 5A, when the amount of curl of the sheet S is less than a predetermined amount, the actuator 612 detects that the flag 611 is not tilted to or beyond the flag detection position 613. Consequently, the pressure sensor 9*b* outputs a detection signal at a LOW level. As shown in FIG. 5B, when the amount of curl of the sheet S is larger than a predetermined amount, the actuator 612 detects that the flag 611 is tilted beyond the flag detection position 613. Consequently, the pressure sensor 9*b* outputs a detection signal at a HIGH level.

The control section 50 controls the roller-separation distance of the decurling section 17 based on the detection signal supplied by the pressure sensor 9*b*, thereby adjusting the nip width H1 and the engaging depth H2. The control section 50 reduces the nip width H1 of the decurling section 17 when the amount of curl of the sheet S caused by ejected ink is small. The control section 50 controls to increase the nip width H1 of the decurling section 17 when the amount of curl of the sheet S is large. Consequently, the control section 50 controls the decurling section 17 to reduce the amount of decurling applied to the sheet S as the amount of curl of the sheet S is smaller. Also, the control section 50 controls the decurling section 17 to increase the amount of decurling applied to the sheet S as the amount of curl of the sheet S is larger.

Figure 6A:
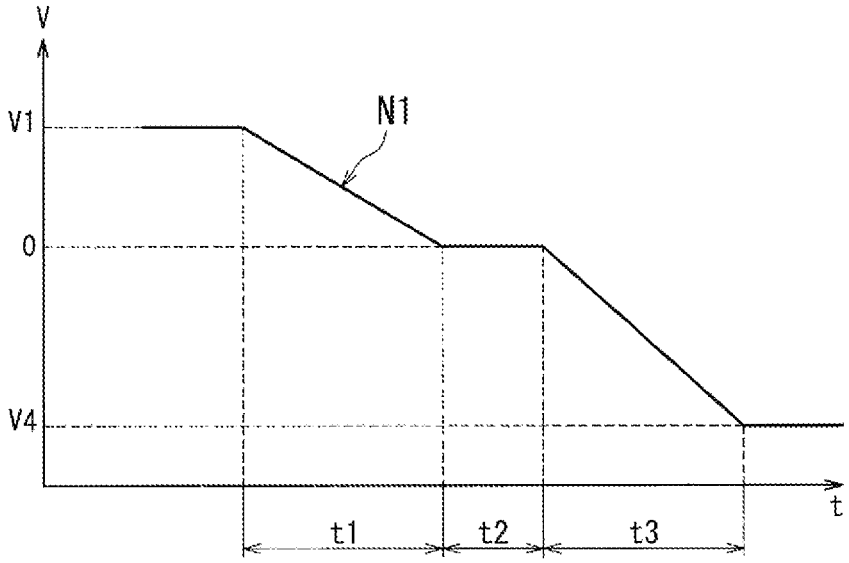
FIGS. 6A and 6B are graphs each representing the relation between a sheet conveyance speed and a sheet conveyance time set in the conveyor device according to the embodiment of the present disclosure.
Figure 6B:
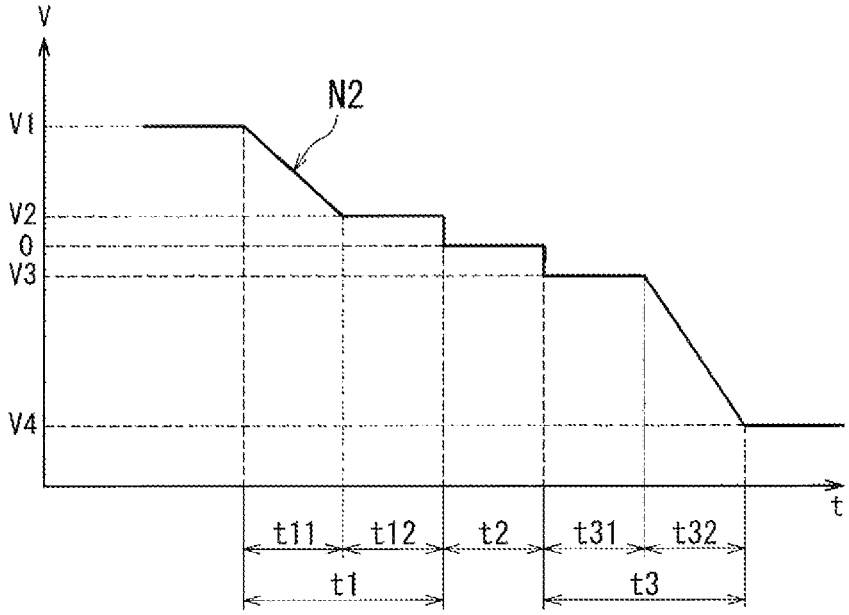

With reference to FIGS. 1, 6A, and 6B, the following explains a speed-reduction time t1. The control section 50 adjusts the speed-reduction time t1 by controlling the reversing section 18 based on the one or more parameters. The speed-reduction time t1 refers to a time period from when the conveyance speed of the sheet S is started to be reduced to when the sheet S being conveyed is stopped.

The longer speed-reduction time t1 means that the sheet S remains contact with the decurling section 17 for a longer period of time. As a consequence, decurling by the decurling section 17 is applied to a larger part of the sheet S. This prevents decurling from being locally applied to the sheet S. In other words, awkward decurling of the sheet S is prevented.

FIGS. 6A and 6B show the relation between the conveyance time of the sheet S and the conveyance speed of the sheet S in the reverse conveyance path 16. The vertical axis represents the conveyance speed of the sheet S, and the horizontal axis represents time. FIG. 6A shows the conveyance speed of the sheet S that is varied at a constant acceleration given by the control section 50. FIG. 6B shows the conveyance speed of the sheet S that is varied at an acceleration controlled by the control section 50. Each of the curves N1 and N2 represents change in the conveyance speed relative to the conveyance time of the sheet S under the corresponding conditions.

The speed-reduction time t1 indicates a time period from when the conveyance speed of the sheet S is started to be reduced to when the sheet S being conveyed is stopped. A stop time t2 indicates a time period during which the sheet S is temporarily held stopped in the reverse conveyance path 16. An acceleration time t3 is a time period during which the sheet S being conveyed in the reverse conveyance path 16 toward the second conveyance path 19 is accelerated. In FIG. 6B, the speed-reduction time t11 indicates a time period taken for changing the conveyance speed of the sheet S being conveyed in the conveyance direction B from the conveyance speed V1 to the conveyance speed V2 (minimum speed). The speed-reduction time t12 indicates a time period during which the sheet S is conveyed in the conveyance direction B at the conveyance speed V2. The acceleration time t31 indicates a time period during which the sheet S is conveyed in the conveyance direction C at the conveyance speed V3 (minimum speed). The acceleration time t32 indicates a time period taken for changing the conveyance speed of the sheet S from the conveyance speed V3 to the conveyance speed V4.

The conveyance speed V1 indicates the conveyance speed at which the sheet S entered the reverse conveyance path 16 is conveyed until the conveyance speed is started to be reduced. The conveyance speed V2 (the minimum speed at which the sheet S is conveyed in the conveyance direction B) indicates the speed at which the sheet S is conveyed when the trailing edge of the sheet S passes through the decurling section 17. The conveyance speed V3 (the minimum speed at which the sheet S is conveyed in the conveyance direction C) indicates the speed at which the sheet S is conveyed during the time the trailing edge of the sheet S passes through the decurling section 17. The conveyance speed V4 indicates the speed at which the sheet S is conveyed in the second conveyance path 19.

The amount of decurling applied to the sheet S by the decurling section 17 increases with a decrease in the conveyance speed of the sheet S contacting the decurling section 17. Therefore, in order to increase the amount of decurling applied to the sheet S, it is preferable to reduce the conveyance speed of the sheet S in the reverse conveyance path 16 where the decurling section 17 is disposed.

Next, the acceleration of the sheet S conveyed in the reverse conveyance path 16 is specifically explained with reference to FIGS. 6A and 6B. As represented by the curve N1 in FIG. 6A, the conveyance speed of the sheet S is reduced at a constant acceleration during the speed-reduction time t1. As represented by the curve N2 in FIG. 6B, during the speed-reduction time t1, the conveyance speed of the sheet S is reduced at a constant acceleration that is greater than the acceleration represented by the curve N1. The conveyance speed of the sheet S is then kept constant during the speed-reduction time t12.

That is, in the example shown in FIG. 6A, the conveyance speed of the sheet S is reduced at a constant acceleration throughout the speed-reduction time t1. In the example shown in FIG. 6B, the conveyance speed of the sheet S is reduced at a constant acceleration that is greater than the acceleration represented by the curve N1 during the speed-reduction time t11 and then kept at the conveyance speed V2 (minimum speed) during the speed-reduction time t12. With the conveyance of the sheet S as in the example shown in FIG. 6B, the decurling section 17 can apply decurling more intensively to the trailing edge of the sheet S being conveyed in the conveyance direction B.

The explanation given above leads to that the time taken for the sheet S to pass through the decurling section 17 is longer when the sheet S is conveyed with an acceleration adjusted by the control section 50, as compared to when the sheet S is conveyed with a constant acceleration. Therefore, by adjusting the acceleration of the sheet S, decurling is applied more intensively to the trailing edge of the sheet S being conveyed in the conveyance direction B. This prevents the sheet S from contacting the image forming section 300 when the sheet S is conveyed back to a position immediately under the image forming section 300. As described above, it is preferable that the acceleration of the sheet S conveyed in the image forming apparatus 100 is controlled by the control section 50.

The following specifically explains a preferable example of the speed-reduction time t1, which is a time period from when the conveyance speed of the sheet S starts to be reduced to when the sheet S being conveyed is stopped. Preferably, the speed-reduction time t1 is set to fall within a range of 10 msec and 8,000 msec. More preferably, the speed-reduction time t1 is set to fall within a range of 100 msec to 2,000 msec, in consideration that the sheet S passes through the decurling section 17.

With reference to FIGS. 1, 6A, and 6B, the following explains a stop time t2. The stop time t2 refers to a time period during which the sheet S being conveyed within the image forming apparatus 100 is held stopped in the reverse conveyance path 16. The control section 50 controls the reversing section 18 based on the one or more parameters to adjust the time period during which the sheet S is held stopped in the reverse conveyance path 16. The control section 50 stops the drive of the motor of the reversing section 18, thereby temporarily stopping the sheet S in the reverse conveyance path 16. After the passage of the stop time t2, the control section 50 controls the motor of the reversing section 18 to rotate in a direction opposite to the direction of the motor rotation driven when the sheet S is fed into the reverse conveyance path 16, thereby feeding the sheet S into the second conveyance path 19.

The following explains a preferable example of a stop time t2. The stop time t2 refers to a time period during which the sheet S is temporarily held stopped in the reverse conveyance path 16. Preferably, the stop time t2 is set to fall within a range of 10 msec and 8,000 msec. More preferably, the stop time t2 is set to fall within a range of 100 msec and 2,000 msec. The stop time t2 may be made longer when an image to be formed on the sheet S contains a high density portion.

With reference to FIGS. 1 and 6A and 6B, the following explains the acceleration time t3 during which the sheet S being conveyed in the reverse conveyance path 16 is accelerated. The control section 50 controls the reversing section 18 based on the one or more parameters to adjust the acceleration time t3. The acceleration time t3 represents a time period during which the sheet S conveyed from the reverse conveyance path 16 toward the second conveyance path 19 is accelerated.

The time period during which the sheet S is in contact with the decurling section 17 increases with an increase in the acceleration time t3 for the sheet S being conveyed in the reverse conveyance path 16 toward the second conveyance path 19, i.e., for the sheet S passing through the decurling section 17 for the second time. As a consequence, decurling by the decurling section 17 is applied to a larger part of the sheet S. This prevents decurling to be locally applied to the sheet S. In other words, awkward decurling of the sheet S is prevented.

As has been described above, the amount of decurling applied to the sheet S by the decurling section 17 increases with a decrease in the conveyance speed of the sheet S contacting the decurling section 17. In view of this, in order to increase the amount of decurling to be applied to the sheet S, it is preferable to reduce the conveyance speed of sheet S being conveyed in the reverse conveyance path 16 toward the second conveyance path 19.

Next, with reference to FIGS. 6A and 6B, the acceleration of the sheet S conveyed from the reverse conveyance path 16 toward the second conveyance path 19 is specifically explained. As represented by the curve N1 shown in FIG. 6A, the conveyance speed of the sheet S is increased at a constant acceleration during the acceleration time t3. As represented by the curve N2 shown in FIG. 6B, the conveyance speed of the sheet S is kept constant during the acceleration time t31 and then increased during the acceleration time t32 at an acceleration greater than the acceleration represented by the curve N1.

As compared with the conveyance of the sheet S with a constant acceleration throughout the acceleration time T3, conveying the sheet S with an acceleration adjusted during the acceleration time t3 is more effective to apply decurling intensively to the leading edge of the sheet S. More specifically, the sheet S is conveyed at the conveyance speed V3 (minimum speed) during the acceleration time t31 and then accelerated, during the acceleration time t32, at the acceleration represented by the curve N2, which is greater than the acceleration represented by the curve N1. With such conveyance of the sheet S, the decurling section 17 can apply decurling intensively to the leading edge of the sheet S being conveyed in the conveyance direction C.

The explanation given above leads to that time period during which the sheet S is conveyed at the conveyance speed V3 is longer when the sheet S is conveyed with an acceleration adjusted by the control section 50, as compared to when the sheet S is conveyed with a constant acceleration. Therefore, by adjusting the acceleration of the sheet S, decurling is applied more intensively to the leading edge of the sheet S being conveyed in the conveyance direction C. This prevents the sheet S from contacting the image forming section 300 when the sheet S is conveyed back to a position immediately under the image forming section 300. As described above, it is preferable that the acceleration of the sheet S is controlled by the control section 50.

The following explains a preferable example of the acceleration time t3 for conveying the sheet S in the reverse conveyance path 16 toward the second conveyance path 19. Preferably, the acceleration time t3 is set to fall within a range of 10 msec and 8,000 msec. More preferably, the acceleration time t3 for conveying the sheet S in the reverse conveyance path 16 toward the second conveyance path 19 is set to fall within a range of 100 msec to 2,000 msec.

The control section 50 controls the reversing section 18 based on the one or more parameters so as to adjust the conveyance speed of the sheet S being conveyed toward the second conveyance path 19, i.e., of the sheet S conveyed through the reverse conveyance path 16.

The time period during which the sheet S remains in contact with the decurling section 17 increases with a decrease in the conveyance speed of the sheet S passing through the decurling section 17. As a consequence, the amount of decurling applied to the sheet S by the decurling section 17 increases.

For example, the reversing section 18 may be implemented by the decurling section 17. With the above configuration, the decurling section 17 of the conveyor device 1 is capable of applying decurling to the sheet S and reversing the conveyance direction of the sheet S conveyed in the reverse conveyance path 16. This configuration enables the reversing section 18 to be omitted from the conveyor device 1.

Figure 7:
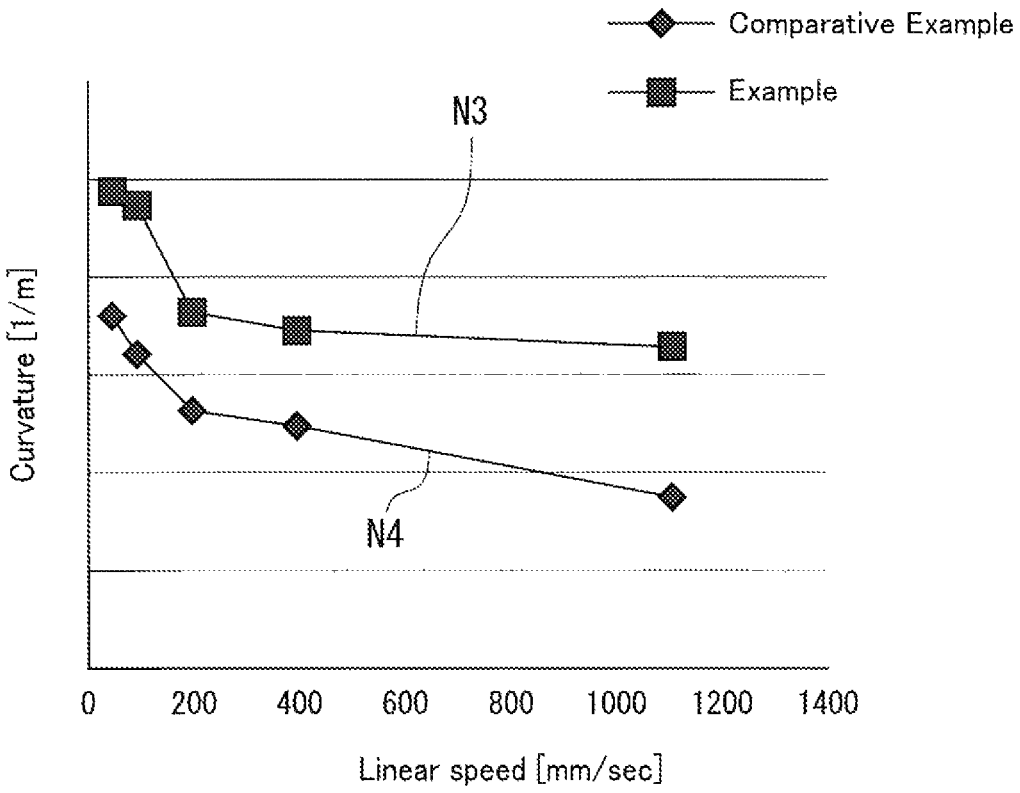
FIG. 7 is a graph representing the relation between a curvature and a linear speed of a sheet conveyed by the conveyor device according to the present embodiment of the present disclosure and by a conveyor device of a comparative example.

With reference to FIGS. 1 to 3B, 6A, 6B, and 7, the following explains the relation between the curvature and the linear speed of the sheet S. FIG. 7 is a graph representing the relation between the linear speed and the curvature of a sheet S conveyed by the conveyor device 1 of Example and by a conveyor device of Comparative Example. The conveyor device of Comparative Example is provided with a decurling section 17 disposed in a second conveyance path 19. The conveyor device 1 of Example is the conveyor device 1 according to the present embodiment.

For comparison of the conveyor device 1 of Example with the conveyor device of Comparative Example, an experiment was conducted under the following conditions. The decurling section 17 in each conveyor device included two rollers paired with each other. The diameter of the soft roller 501 was ϕ25 mm, and the diameter of the hard roller 502 was ϕ7 mm. The soft roller 501 was made of urethane sponge roller having a hardness of 20°. The engaging depth H2 of the soft roller 501 by the hard roller 502 was 1.7 mm.

The stop position of the sheet S on the reverse conveyance path 16 was determined such that the length Z1 was 5 mm. The stop time t2 was set to 500 msec. The speed-reduction time t1 and the acceleration time t3 were each set to 100 msec. The basis weight of each sheet S was 70 g/m$^2$. In the experiment, the sheet S was subjected to a printing process of forming a blank image on the first printed side and the second printed side by conveying the sheet S at a varying linear speed.

In FIG. 7, the vertical axis represents the curvature of the sheet S. In each of the conveyor device 1 of Example and the conveyor device of Comparative Example, the curvature refers to the curvature of a sheet S after the image forming section 300 performs a print process on the first and second printing sides of the sheet S without ejecting ink. The curve N3 represents change in the curvature of the sheet S relative to the linear speed of the sheet S conveyed by the conveyor device 1 of Example mounted on the image forming apparatus 100. The curve N4 represents change in the curvature of the sheet S relative to the linear speed of the sheet S conveyed by the conveyor device of Comparative Example mounted on the image forming apparatus 100.

The curvature of the sheet S processed by the image forming apparatus 100 having the conveyor device 1 of Example 1 was greater than the curvature of the sheet S processed by the image forming apparatus 100 having the conveyor device of Comparative Example. In addition, the change in the curvature of the sheet S responsive to an increase in the linear speed was smaller in the sheet S processed by the image forming apparatus 100 having the conveyor device 1 of Example than in the sheet S processed by the image forming apparatus 100 having the conveyor device of Comparative Example. As explained above, the curvature of the sheet S conveyed by the conveyor device 1 of Example was confirmed to be greater than the curvature of the sheet S conveyed by the conveyor device of Comparative Example.

As has described above, the conveyor device 1 according to the present embodiment is provided with the decurling section 17 disposed on the reverse conveyance path 16 to apply decurling to the sheet S by urging the non-printed side of the sheet S in a direction of forming a convex curl with the side opposite to the image-formed side facing outward. This prevents the sheet S from contacting the image forming section 300 when the sheet S is conveyed to the image forming section 300. As a result, contamination of the sheet S is prevented.

Up to this point, the embodiment of the present disclosure has been described with reference to FIGS. 1A to 7. However, the present disclosure is not limited to the specific embodiment described above. In addition, the same reference signs are used to denote the same or corresponding components, and no overlapping explanation is repeated. The drawings schematically show relevant components to give a clear understanding. The thickness, length, and number of components shown in the figures may differ from the actual ones for the sake of convenience in the drawings. In addition, the material, configuration, dimensions of each component mentioned in the embodiment above are merely an example and without limitation. Various alterations including the following may be made without substantially departing from the effect of the present disclosure.

(1) As described with reference to FIG. 1, one decurling section 17 is disposed on the reverse conveyance path 16. However, the number of the decurling sections 17 that can be disposed on the reverse conveyance path 16 is not limited to one, and a plurality of decurling sections 17 may be disposed.

(2) As described with reference to FIG. 1, the decurling section 17 and the reversing section 18 are disposed in the stated order in the conveyance direction B of the sheet S. However, the reversing section 18 and the decurling section 17 may be disposed in the stated order in the conveyance direction B of the sheet S.

(3) As described with reference to FIGS. 1, 4A, 4B, 5A, and 5B, the displacement sensor 9 is disposed between the second belt conveyor section 14 and the first conveyance path 15. However, the position of the displacement sensor 9 is not limited to such, as long as the displacement sensor 9 is located upstream from the decurling section 17 in the conveyance direction A of the sheet S. The displacement sensor 9 may be a jam detection sensor included in the image forming apparatus 100.

What is claimed is:

1. A conveyor device for mounting on an image forming apparatus, the image forming apparatus including an image forming section for forming an image on a sheet, the conveyor device having:

a first conveyance path through which a sheet is conveyed after an image is formed on a side of the sheet by the image forming section;

a reverse conveyance path branched from the first conveyance path; and a second conveyance path branched from the reverse conveyance path and through which the sheet is conveyed back to the image forming section, and the conveyor device comprising:

a reversing section disposed on the reverse conveyance path;

a decurling section spaced apart from the reversing section on the reverse conveyance path; and a controller configured to control the reversing section, wherein in a situation in which the sheet is not conveyed to the reversing section, the sheet is ejected onto an exit tray without passing through the decurling section and the reversing section, the controller controls the reversing section based on a parameter so as to adjust either or both of:

a conveyance speed at which the sheet is conveyed in the reverse conveyance path and a position at which the sheet is stopped in the reverse conveyance path, the parameter is at least one from among an amount of curl of the sheet, a material of the sheet, a size of the sheet, a thickness of the sheet, an image density of the image formed on the sheet, a temperature, and a humidity, the reversing section reverses a conveyance direction of the sheet that is fed into the reverse conveyance path so as to feed the sheet into the second conveyance path, the decurling section applies decurling by urging the sheet in a direction of forming a convex curl with a side opposite to the image-formed side facing outward, the controller controls the reversing section based on the parameter so as to adjust acceleration time indicating a time period taken for changing a conveyance speed of the sheet from a first minimum speed to a first conveyance speed, the first minimum speed is a minimum speed at which the sheet is fed from the reverse conveyance path into the second conveyance path, and the first conveyance speed indicates a speed at which the sheet is conveyed in the second conveyance path.

2. A conveyor device according to claim 1, wherein the decurling section is disposed between the reversing section and a branch section at which the second conveyance path branches from the reverse conveyance path.

3. A conveyor device according to claim 1, wherein the controller controls the reversing section based on the parameter so as to cause the sheet to be stopped at a position where the sheet contacts the decurling section.

4. A conveyor device according to claim 1, wherein the controller controls the reversing section based on the parameter so as to adjust a speed-reduction time, the speed-reduction time being a time period taken for changing the conveyance speed of the sheet from a second conveyance speed to a second minimum speed, the second conveyance speed indicates a conveyance speed at which the sheet entered the reverse conveyance path is conveyed until the conveyance speed is started to be reduced, and the second minimum speed indicates a minimum speed at which the sheet is conveyed in a direction in which the sheet enters the reverse conveyance path.

5. An conveyor device according to claim 4, wherein the controller controls the reversing section based on the parameter to convey the sheet at the second minimum speed during a first predetermined time, hold the sheet in the reverse conveyance path during a second predetermined time, and convey the sheet at the first minimum speed during a third predetermined time, the second minimum speed is constant, and the first minimum speed is constant.

6. An conveyor device according to claim 5, wherein the controller sets a time to be fixed and determines the first predetermined time based on the time and the adjusted speed-reduction time, and the controller sets a time to be fixed and determines the third predetermined time based on the time and the adjusted acceleration time, the time based on which the first predetermined time is determined is a time period from when the sheet enters the reverse conveyance path to when the sheet is stopped, and the time based on which the third predetermined time is determined is a time period during which the sheet is conveyed toward the second conveyance path from the reverse conveyance path after the sheet is stopped in the reverses conveyance path.

7. A conveyor device according to claim 1, wherein the controller controls the reversing section based on the parameter so as to adjust a time period during which the sheet is held stopped in the reverse conveyance path.

8. A conveyor device according to claim 1, the controller controls the decurling section based on the parameter so as to adjust an amount of decurling applied to the sheet.

9. A conveyor device according to claim 1, wherein the reversing section is implemented by the decurling section.

10. A conveyor device according to claim 1, further comprising a displacement sensor configured to measure an amount of curl of the sheet.

11. A conveyor device according to claim 10, wherein the displacement sensor is a distance sensor.

12. A conveyor device according to claim 10, wherein the displacement sensor is a pressure sensor.

13. A conveyor device according to claim 1, wherein the decurling section includes two rollers paired with each other.

14. A conveyor device according to claim 1, wherein the decurling section includes a belt and a roller paired with the belt.

15. An image forming apparatus comprising:

a conveyor device according to claim 1; and an image forming section configured to form an image on a sheet.

16. A conveyor device for mounting on an image forming apparatus, the image forming apparatus including an image forming section for forming an image on a sheet, the conveyor device having:

a first conveyance path through which a sheet is conveyed after an image is formed on a side of the sheet by the image forming section;

a reverse conveyance path branched from the first conveyance path; and a second conveyance path branched from the reverse conveyance path and through which the sheet is conveyed back to the image forming section, the conveyor device comprising:

a reversing section disposed on the reverse conveyance path;

a decurling section spaced apart from the reversing section on the reverse conveyance path; and a controller configured to control the reversing section, wherein in a situation in which the sheet is not conveyed to the reversing section, the sheet is ejected onto an exit tray without passing through the decurling section and the reversing section, the controller controls the reversing section based on a parameter so as to adjust either or both of:

a conveyance speed at which the sheet is conveyed in the reverse conveyance path and a position at which the sheet is stopped in the reverse conveyance path, the parameter is at least one from among an amount of curl of the sheet, a material of the sheet, a size of the sheet, a thickness of the sheet, an image density of the image formed on the sheet, a temperature, and a humidity, the reversing section reverses a conveyance direction of the sheet that is fed into the reverse conveyance path so as to feed the sheet into the second conveyance path, the decurling section applies decurling by urging the sheet in a direction of forming a convex curl with a side opposite to the image-formed side facing outward, the controller controls the reversing section based on the parameter so as to adjust a speed-reduction time taken for changing the predetermined conveyance speed of the sheet to a predetermined minimum speed, the predetermined conveyance speed indicates a speed at which the sheet entered the reverse conveyance path is conveyed until the conveyance speed is started to be reduced, and the predetermined minimum speed indicates a minimum speed at which the sheet is conveyed in a direction in which the sheet enters the reverse conveyance path.

* * * * *